US005816788A

United States Patent [19]

Yakirevich

[11] Patent Number: 5,816,788

[45] Date of Patent: Oct. 6, 1998

[54] ROTARY ENGINE HAVING A TRANSMISSION INCLUDING HALF-PINIONS AND CAMS

[76] Inventor: Yakov Yakirevich, 209 Ave. P, #B7, Brooklyn, N.Y. 11204

[21] Appl. No.: 676,798

[22] Filed: Jul. 8, 1996

[51] Int. Cl.[6] ..... F01C 1/077

[52] U.S. Cl. ..... 418/36

[58] Field of Search ..... 418/35–38

[56] References Cited

U.S. PATENT DOCUMENTS

| | | | |
|---|---|---|---|
| 2,248,029 | 7/1941 | Uzcudun et al. | 418/36 |
| 3,820,516 | 6/1974 | Paleologos | 418/36 |
| 4,413,961 | 11/1983 | Griffin | 418/38 |
| 5,224,847 | 7/1993 | Kurisu | 418/36 |

FOREIGN PATENT DOCUMENTS

| | | | |
|---|---|---|---|
| 2606360 | 8/1977 | Germany | 418/38 |

*Primary Examiner*—John J. Vrablik
*Attorney, Agent, or Firm*—Ilya Zborovsky

[57] ABSTRACT

A rotary engine, has a stationary casing having an internal cylindrical surface with an axis, two substantially identical cylindrical rotors rotatable about a common axis coinciding with the axis of the cylindrical surface in a start mode and a stop mode in a same direction so that one rotor starts to move before another rotor finishes its movement to provide a common turn by ψ, a power output shaft rotatable mounted in the casing and having an axis of rotation which is parallel to and displaced from the common axis of the rotors; transmission a unit including two substantially identical half-pinions which are mounted on the shaft and angularly displaced relative to one another by an angle of 180°, and a unit producing an alternate movement of the rotors in the start and stop modes, the alternate movement producing a unit including two substantially identical cylindrical cams which are mounted on the shaft and angularly displaced relative to one another at an angular of substantially 180°.

7 Claims, 9 Drawing Sheets

FIG. 4A
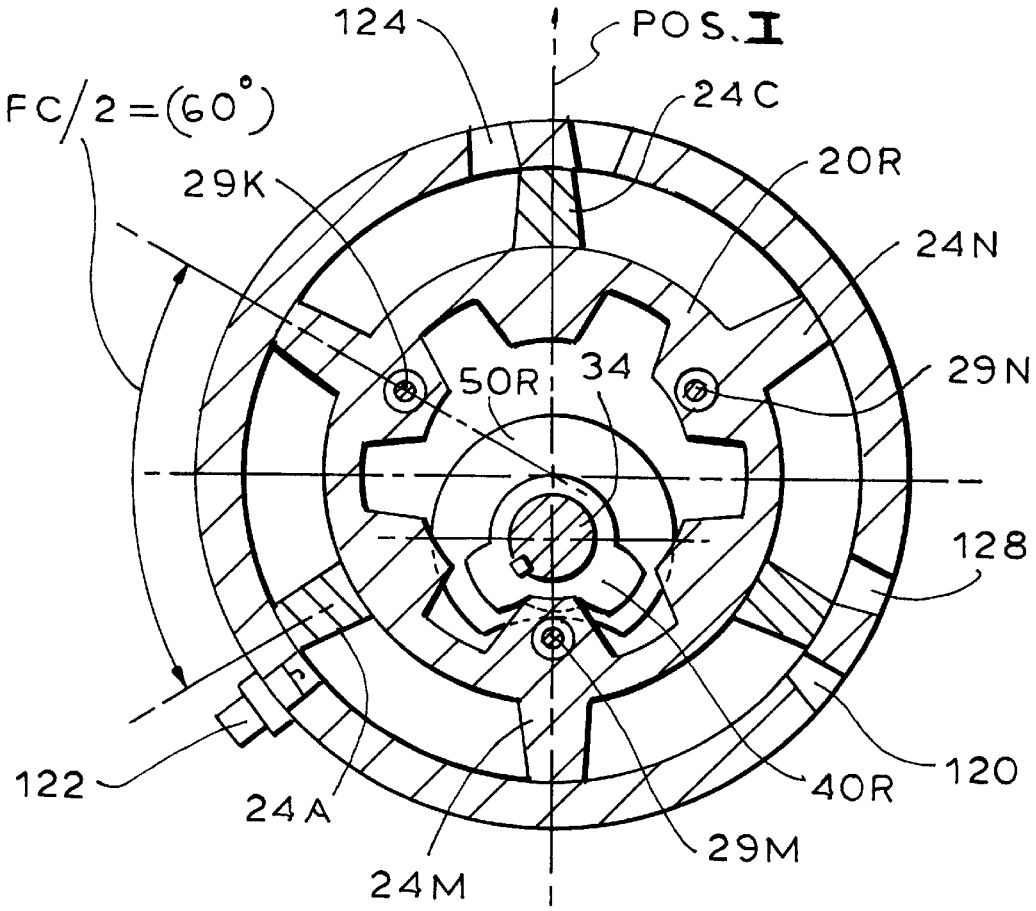
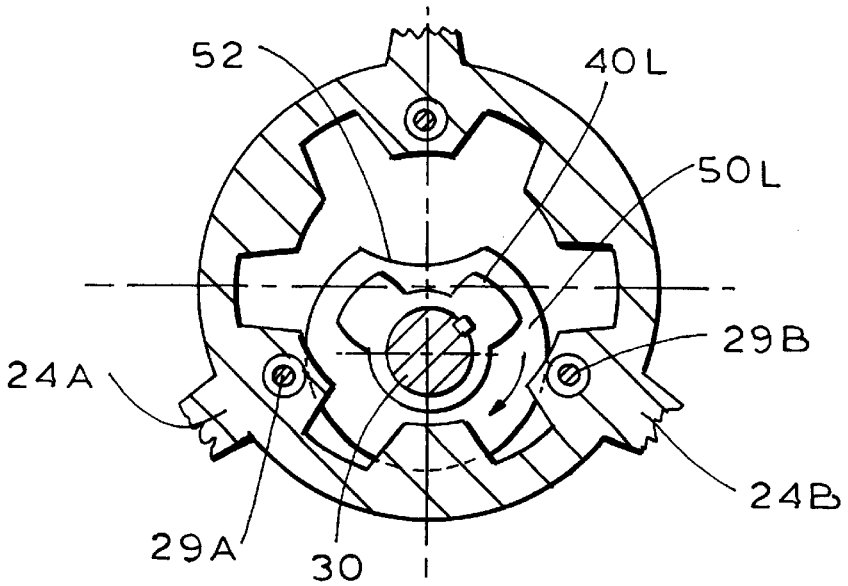
FIG. 4B

FIG. 5A
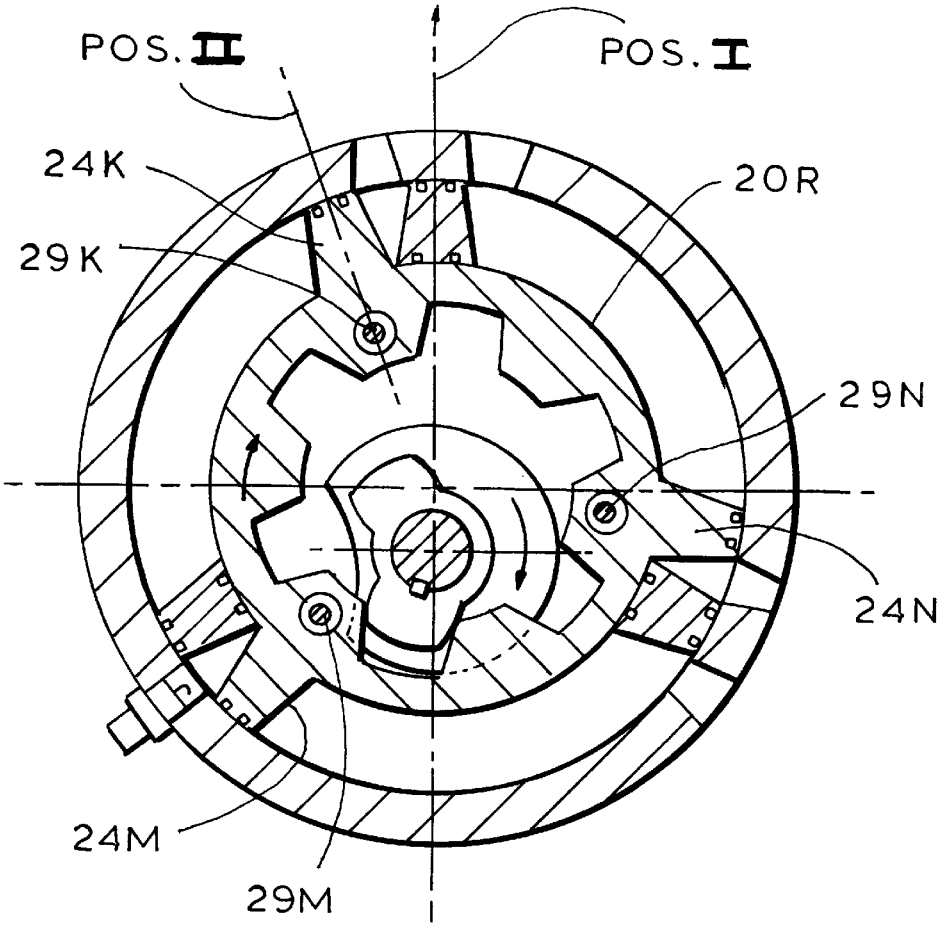
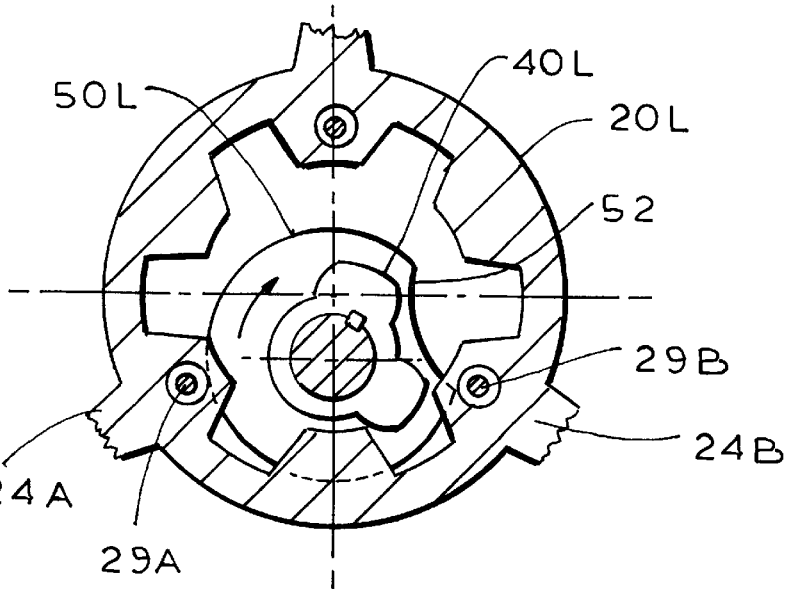
FIG. 5B

FIG. 6A
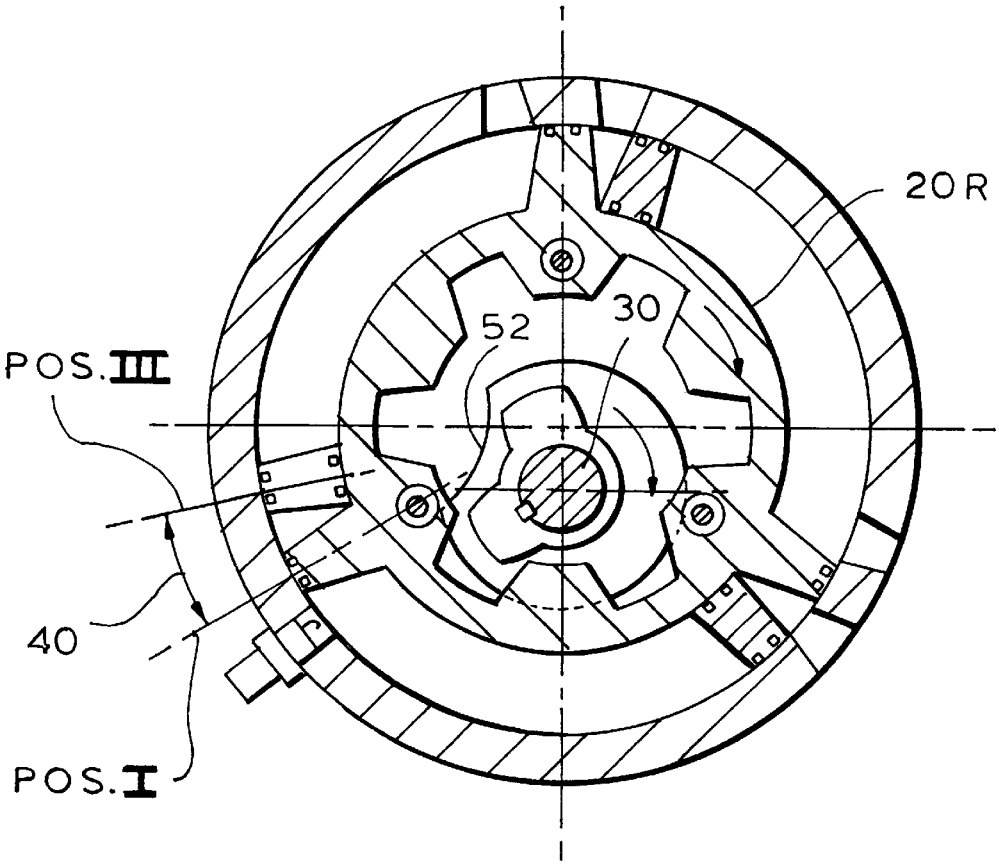
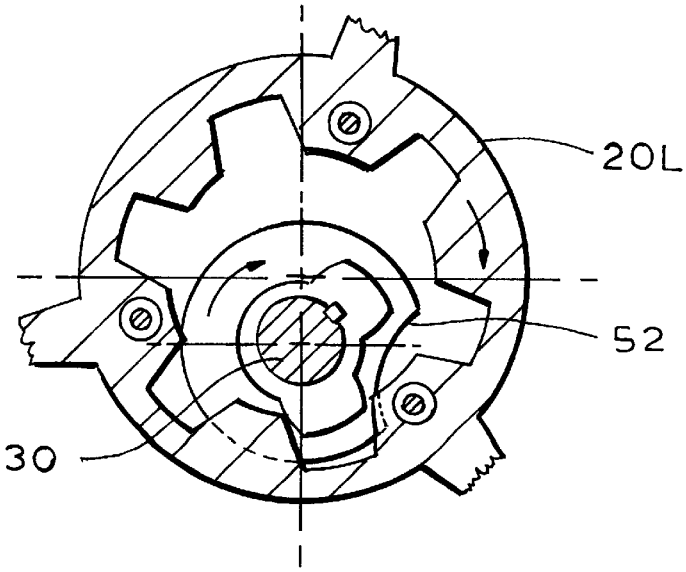
FIG. 6B

| ROTOR | № № CIRCLES | STRUKE'S NAMES | VOLUME |
|---|---|---|---|
| R | WC 1 | INPUT (FUEL) | INCREASE |
| L | WC 2 | COMPRESSION, COMBASTION | DECREASE |
| R | WC 3 | POWER | INCREASE |
| L | WC 4 | 1 ST EXHAUST | DECREASE |
| R | WC 5 | INPUT ( AIR ) | INCREASE |
| L | WC 6 | 2 ND EXHAUST | DECREASE |

ROTARY ENGINE HAVING A TRANSMISSION INCLUDING HALF-PINIONS AND CAMS

BACKGROUND OF THE INVENTION

The present invention relates generally to a rotary internal combustion engine, and in particular, relates to the internal combustion engine having two cylindrical rotors which rotate about their common axis within a cylindrical housing.

Internal combustion engines include piston engines and the rotary Wankel engines. The Wankel engine has the simpler design since it does not have numerous moving parts and elements. It does not need special mechanisms to perform mechanical operations, such as valves, connecting rods, pistons and camshaft. Therefore, for the power produced, a rotary Wankel engine is smaller, lighter, and less costly. However, some defects of the Wankel engine, such as low thermal efficiency, high fuel consumption, and high pollution levels, limited the application of this type of engine for the mass produced automobiles. That is why the rotary engines are primarily used in lawn mowers, motor cycles, snowmobiles, and model airplanes.

There have been numerous efforts to improve the Wankel engine while preserving the potential advantages of a rotary engine. These designs have proved to be of only theoretical interest because they introduced new problems without the fundamental element of the characteristics of the current Wankel engine. For example, U.S. Pat. No. 3,985,110 demonstrates the advantages and drawbacks of a new designs of rotary engine. The engine disclosed in this patent has a pair of coaxial rotors rotating concentrically within a cylindrical housing. The internal surface of the housing is coaxial to both rotors. Certainly, the configuration of such rotors and their geometrical disposition inside the housing can significantly decrease fuel losses and improve its dynamic characteristics compared to the Wankel engine. However, the chosen form of motion of the rotors, which generates a multi-stroke or, more accurately, multi-position model of rotary engine, makes such an engine more complicated in design and more costly to manufacture. This is because it has complicated mechanisms converting motion of rotors into shaft rotation, additional mechanisms for controlling the operations of the engine which do not prevent high fuel losses, and a complicated ignition system leading to decreasing probability of a failure free performance. In addition, a part of the power produced by the engine must be used to provide functioning of these additional mechanisms.

The concept of building engines based on multi-position arrangement of rotors motion described above does not accomplish its goals. For example, lower rotational frequency of the shaft during one cycle, when compared to a piston engine or the Wankel engine, because of its location on the same axis with rotors, significantly narrows the spectrum of possible applications of such an engine. Moreover, the low rotational frequency of the shaft is further decreased because of the increased number of diaphragms of the rotor, (i.e. with increased number of strokes within a cycle). In the meantime, the size and weight of such an engine will increase because of certain proportional relationships which must exist between the volume of the air-fuel mixture used and the length of the displacement of a rotor (or a piston) for an engine to perform adequately. In addition, the decreased force of inertia of the flywheel will have a negative impact on the fuel consumption characteristics. For the reasons mentioned above, the implementation of such a design in standard vehicles is practically impossible. It should be also noted that the goal to provide smoother rotation of the shaft, similar to that in an 8-cylinder piston engine, with implementation of multi-positioning design, cannot be achieved. In such a design a frequency of impact of the burning air-fuel mixture energy on the shaft within one cycle remains similar to that in a 4-cylinder piston engine (i.e. the next cycle starts when the previous one is finished).

U.S. Pat. No. 4,666,379 discloses a rotary engine whose performance is particularly identical to the one described in U.S. Pat. No. 3,985,110. It is based on multi-positioning motion of two rotors about a common axis and has all drawbacks attributed to such a design. Despite a simpler scheme that controls the rotor motion in a start-stop cycle and transmits torque to the shaft from those rotors using mechanisms, such as an overrunning clutch, the use of such schemes in internal combustion engines is not efficient. Under conditions of constantly changing kinetic modes of the engine performance, such a design would have low reliability in transmitting considerable torque and providing a stable position of the rotors, when they stop in the end of a cycle.

SUMMARY OF THE INVENTION

Accordingly, it is an object of the present invention to provide a rotary internal combustion engine which avoids the disadvantages of the prior art.

In keeping with these objects and with others which will become apparent hereinafter, one feature of the present invention resides, briefly stated, in a rotary engine which has a stationary casing having a hollow interior, including an internal cylindrical surface, two identical cylindrical rotors, which rotate about their common axis coinciding with the axis of the cylindrical surface of the casing mentioned above in a start and stop modes in the same direction that every following rotor is beginning to move before the previous one finished its motion making, thus, a common turn to $\psi°$, a power output shaft, journaled in the casing, whose axis of rotation is parallel and displaced relative to the common axis of the both rotors, a transmission gear including two similar half-pinions which are mounted on the shaft and angularly displaced relative to each other at an angle of 180°, and a mechanism to produce the alternate motion of the rotors in start and stop modes, and including two similar cylindrical cams which are mounted on the shaft and angularly displaced relative to each other at an angle of 180°.

The present invention significantly improves the performance, economical and ecological characteristics of the rotary internal combustion engine with the implementation of a new inventive cycle. The cycle is based on an alternate motion of two identical multi-diaphragm rotors within a cylindrical housing. One of the common features of all existing internal combustion engines is a cycle, produced by the motion of pistons and rotors. When each cycle begins, the previous one is finished. Drawbacks of this principle will be discussed in the course of analyzing the new cycle process introduced by the present invention. The new scheme introduces a rotor motion, in which a certain overlap between the two cycles is achieved (i.e. each following cycle begins before the previous one is finished). As in the case of the Wankel engine, the full cycle (FC) is formed with a rotor making one 360°/N angular turn, where N is a number of diaphragms on a rotor providing the required number of strokes within a cycle. In the present invention, during the change of cycles both rotors make certain angular turns simultaneously, the beginning of this turn can be characterized as the beginning of FC performed by the next rotor. After both rotors' turn, one of them completes its FC and stops, but the next one keeps turning under pressure from the expansion of gases of the burning air-fuel mixture, and starts a working cycle (WC). Therefore, the period of the WC will be equal to 360°/N-ψ°, where ψ° is a common angular turn of both rotors. The value of this angular turn depends on the width of the rotor diaphragms, which should be designed to withstand the high pressure of expanding gases and to provide sufficient sealing inside the chamber. Since both rotors form FC and WC from the same position relative to the ports of the engine, the present invention significantly simplifies the design compared to the multi-positioning engine. This simpler design is one of the achievements of the present invention. It became possible, because, as in the case of the Wankel engine, the rotors themselves control the mechanical operations of the engine and there is no need to use additional control systems and components, including valves, connecting rods, and camshaft. Meanwhile, the economical and ecological characteristics of the engine will be significantly higher than those of the Wankel engine, because of the chosen design of the rotors and the cylinder.

Another feature of the present invention which also simplifies the design and improves the kinetic characteristics compared to the multi-positioning engine, is a mechanism that controls the motion of the rotors in start-stop cycles and converts this motion into a uniform rotation of the engine's shaft. This mechanism also ensures the stable positioning of the rotors during the cycle process in any of the engine's performance modes. The mechanism is mounted on the shaft of the engine, where the axis of rotation is parallel and displaced relative to the common axis of rotation of both rotors. This allows turning of the shaft 180° with each WC of a rotor. This synchronization is achieved with two half-pinions of the transmitting mechanism, which are displaced along the circumference of the shaft at an angle of 180° relative to each other and engaged with corresponding internal gears of the rotors. The transmission ration between them I=180°/WC ensures the functioning of a chosen form of rotor motion.

Control of "start and stop" motion of rotors during the cycle process is performed by two cams that are also installed on the shaft and displaced at an angle of 180° relative to each other. These cams alternately interact with free revolving rollers of corresponding rotors and by doing so, start motion of one of the rotors (the beginning of FC) and stop of the other one (the end of FC). This is achieved because rotors and cams have different trajectories of motion. In addition, the half pinion and cam mechanism provides smooth engagement and disengagement of rotors to the shaft. Smooth interaction is also provided by forces resulting from the process of combustion of the air-fuel mixture. Negative influence of such forces on the shaft, during common motion of two rotors, is completely neutralized by the mechanism that turns these forces into a positive factor for stopping the rotor. This completes the cycle, smoothly. In other words, during common motion of the two rotors, the influence of internal forces produced in the various chambers on the shaft, regardless of their values, equals zero. This is because during this motion, both rotors are simultaneously engaged with the engine's shaft and present a single common mechanical system, which is balanced by symmetrical forces acting within this system and applied to adjacent diaphragms of the rotors. Such a mechanical system has only one degree of freedom of motion—rotation under the influence of forces of inertia of its own and of the rotating shaft.

In existing types of internal combustion engines with the regular cycle scheme, during the change from one cycle to another, early opening of the exhaust valves causes an abrupt pressure drop from burning gases on pistons or rotors. Thus, the completion of a cycle takes place under the influence of the force of inertia of pistons (rotors) and the shaft. Moreover, a part of this energy is used for the completion of a cycle of mechanical operation. The engine in accordance with the present invention provides significant decrease in the loss of effective power during the completion of a cycle. When both rotors start the common motion (the beginning of their motion under the influence of the force of inertia) all phases of the cycle are completed by the pressure of expanding burning gases on the rotor, which still has not completed its FC and exhaust of gases is still taking place during the completion of the cycle. Therefore, the engine of the present invention provides significant increase of the moment of inertia of moving rotors and the shaft. This increase ensures smoother rotation of the engine's shaft, because by the time the next rotor is about to start WC, the shaft and both rotors rotate in the same direction under the influence of the forces of inertia.

The present invention provides significant increase for the period of combustion. This increases the efficiency of the engine compared to existing designs because better combustion of the compressed air-fuel mixture takes place during the common motion of the two rotors. The length of time, during which both rotors run simultaneously is long enough to allow guaranteed complete burning of the air-fuel mixture.

Better combustion in the engine provides:

increased effective power of the engine per unit of the air-fuel mixture used;

decreased pollution (improved ecological characteristic of performance);

simplified adjustment of the ignition timing (in existing engines this is a relative complicated task and, in most cases, does not ensure the complete burning of the air-fuel mixtures; this leads to lower power, higher fuel consumption, and poor ecological characteristics of the exhaust);

opportunity to use the cheaper and safer types of fuel.

The present invention allows the development of a number of engine modifications whose characteristics would meet certain requirements of various classes of machines using internal combustion engines. For example, in the case of standard automobiles, there are strict requirements established in the area of fuel consumption and control of pollution. The present design allows for additional improvements of fuel consumption and reduced pollutants because of better cleaning of chambers from the products of combustion. As a result, there is an improvement in filling chambers with the air-fuel mixture, and a better and more complete burning of this mixture. Despite the claims in U.S. Pat. No. 3,985,110, the choice of a multi-positioning scheme of the cycle process, as discussed above, does not achieve the goal, because the increasing number of strokes in such an engine leads to lower kinetic characteristics and a significant increase of its size and weight.

The present invention offers an opportunity to create a rotary engine with a pair of three-diaphragm rotors that would form a 6-stroke cycle. Such a design would allow one to perform double cleaning of the chambers. Moreover, using the same amount of fuel during one cycle, the 6-stroke rotary engine would be smaller and lighter compared to the Wankel engine. Another possibility is to develope a 6 stroke carburetor-free rotary engine where additional strokes would be used to supply air under pressure into the chamber creating the air-fuel mixture. Such an engine could be installed in vehicles where power and pollution control are less emphasized (lawn mowers, snowmobiles etc.).

For special vehicles (sports cars and model airplanes) it is necessary to increase horsepower and RPM of an engine, but to keep its weight down and provide balanced performance. These goals can be achieved with the use of an 8-stroke rotary engine with two four-diaphragm rotors that form double, 4-stroke cycle when each rotor makes a 90° angular turn (FC). Although the angular turn in such a design is smaller compared to the three-diaphragm rotary engine, the volume of the air-fuel mixture used (size remains the same) will be 25% higher. This provides a significant increase in effective power of the engine per unit of its weight and also increases the speed of rotation of the shaft. Better balance of performance of the rotary engine with double 4-stroke cycles is achieved with the energy of the expanding gases simultaneously impacting rotors from two positions, which are symmetrically located at an angle of 180° along the circumference of the cylinder.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 7–8 are diagrams illustrating a cycle of operation of the inventive engine.

DESCRIPTION OF PREFERRED EMBODIMENTS

Figure 1:
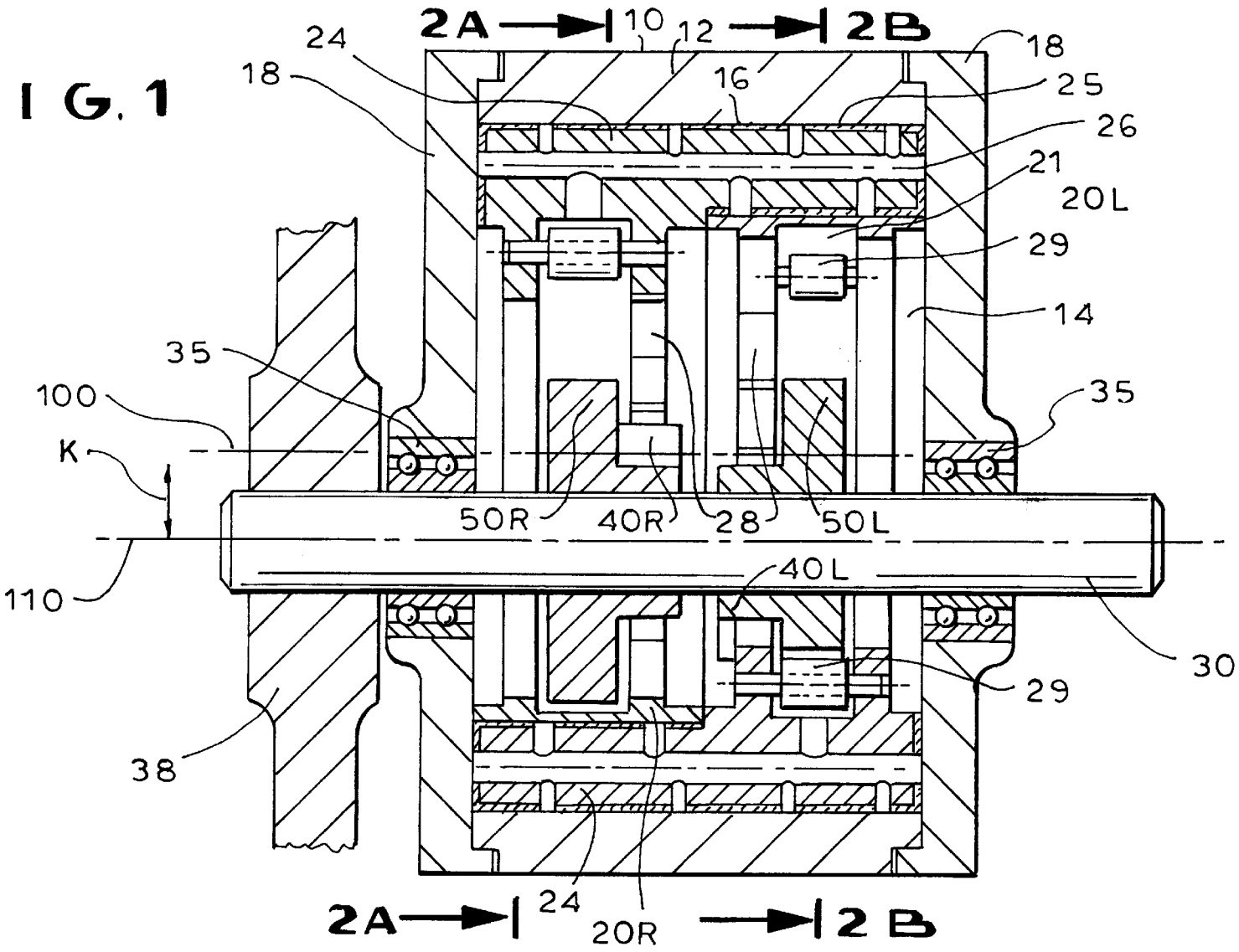
FIG. 1 is a schematical partially, perspective sectional view of an engine in accordance with the present invention with portions of an external housing and portions of both rotors broken away, containing a drive shaft, a cam mechanism and a mechanism of internal gearing.

A rotor engine having 6-stroke cycle constructed according to the present invention is identified as 10 in FIG. 1 and 2. This type of the engine reflects the main point of the present invention the most.

The engine 10 includes a casing 12 in which the moving parts of the engine are located. The casing 12 has a housing 14 with an internal cylindrical surface 16 and two of mirror-image end-sections 18 shown in FIG. 1. The housing 14 has angularly spaced inlet ports (FIG. 2*a*) which provide the following sequence of operations of the engine:

an intake through port 120;

an ignition of an air-fuel mixture by a spark plug 122;

a first exhaust through port 124;

an intake air-cooling through port 126;

a second exhaust through port 128.

Figure 2A:
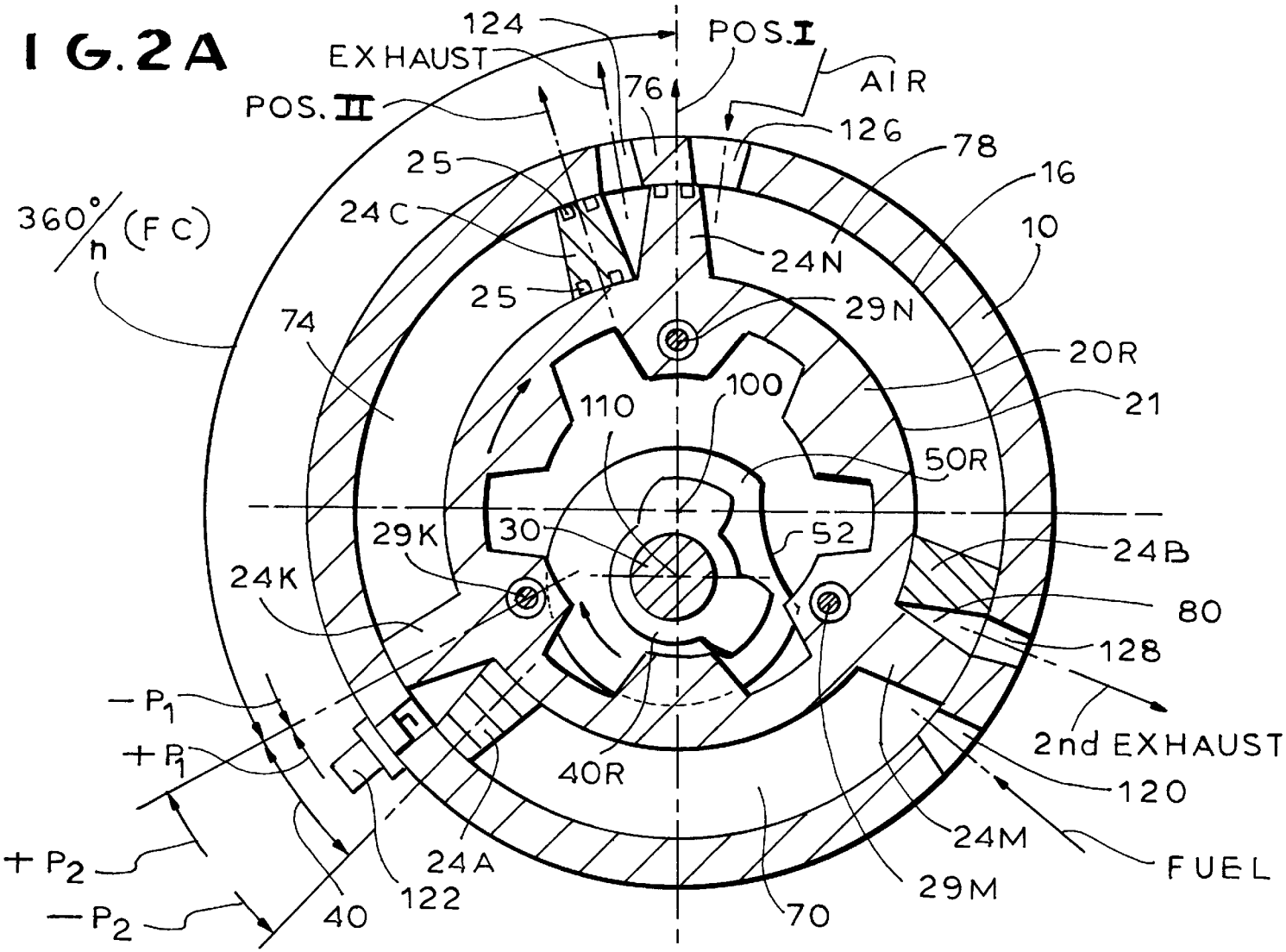
FIG. 2 (*a,b*)–6 (*a,b*) are cross-sectional views of the portions of the six strokes-per-cycle engine taking along the line A—A for a first rotor and along line B—B for a second rotor of FIG. 1 illustrating successive positions of all moving parts of the engine during one cycle.

Two rotors 20L and 20R are mounted in the casing 12 for rotation about an axis 100 (FIG. 1 and 2*a*). Each rotor includes three diaphragms 24 which are displaced proportionally around external cylindrical surface 21 of the rotor. The length of any rotor along its axes of rotation 100 is equal to half length of the diaphragm 24. The internal surfaces of free ends of the diaphragms 24 surround the cylindrical surfaces 21 of opposite rotors and have sliding contacts with said surfaces. Both rotors, therefore, can be displaced relatively to each other about their common axis 100 by a distance L between the adjacent diaphragms, as shown in FIG. 2*a*. All other external surfaces of rotors have also sliding contacts with the internal surfaces of the casing 12.

Sealing elements 25 provide necessary rate of compression inside chambers 70, 72, 74, 76, 78, 80 which are formed between the adjacent diaphragms 24 by the alternately moving rotors 20L and 20R in start-strop mode of their motions. The labyrinth of holes 26 provides an access for introducing lubrication to contacting surfaces of both the rotor and the casing 12, as shown in FIG. 1 and FIG. 2*a*.

Each rotor has an internal gear 28 with an axis of rotation coinciding with the axis 100. Taking into consideration that the sequence of the cycle is realized from the same positions for each rotor relatively to ports 120–128 of the casing 12 (FIG. 2*a*) and depends on their angular turns to 360°/N, the gears 28 must have an even number of teeth z divisible by the number of diaphragms of both rotor "2n." Thus, for example, in three diaphragms version of the engine, Z of the gear 28 can be chosen from the following sequence 6: 6, 12, 18 and so on.

Each rotor has also free rotating rolls (bearings) 29, which provide start and stop modes of the rotors movement, as will be shown below. Their number and angular positions corresponds to the number and positions of the diaphragms 24 on each rotor and their axes of rotation are parallel to the axis 100.

Figure 2B:
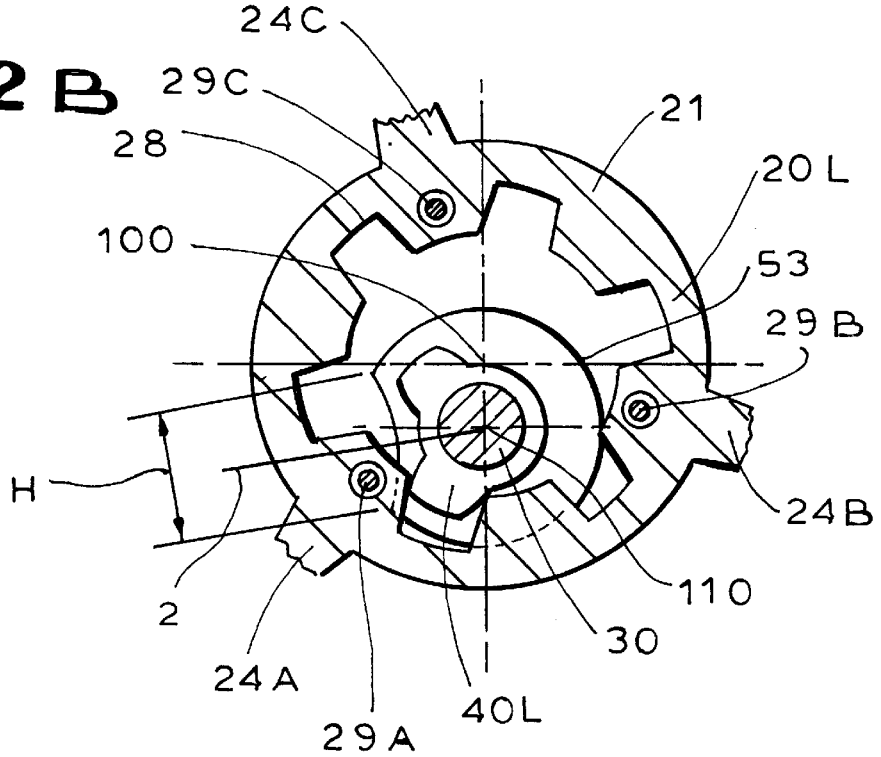

A shaft 30 is rigidly mounted a cavity of the casing 12 and is supported by a bearing 35. A shaft axis 110 is parallel and displaced relatively to the axis 100 by a distance $$K = Do - \frac{do}{2}$$

where Do is a pitch circle of the toothed gear 28 and do is a pitch circle of the half-pinion 40L (40R), fixed with the shaft 30 and are provided for transfer of alternate start-stop motions of the rotors into a uniform motion of the shaft 30. Therefore, the half-pinions 40L and 40R are angularly placed on the shaft 30 with displacement at 180° relative to each other, as shown in FIG. 2*a* and FIG. 2*b*.

The half-pinion 40L works together with the rotor 20L (FIG. 2*b*) and the half-pinion 40R with the rotor 20R. The pitch circle can be defined as do=$^{Do}$/l where l is a transmission ratio between angular turns of 180° of the shaft 30 and angular displacement of any rotor for the period of the WC.

$$do = \frac{DoWC}{2}$$

where WC=360°/N-ψ°; ψ°-is an angle of simultaneous turns of both rotors; n is a number of diaphragms of each rotor, or the number of cycles which are produced by turns of each rotor to 360° because the half-pinions must provide an angular displacement for the shaft 30, when the rotor turns to 360°/N (FC) from the beginning of their gearing connection until a moment of disconnection, the number of teeth Z, of the half-pinion will be (360°/2N:360°/N)+1, or Z/2N+1, where 360°/N is an angular distance between the first and the last teeth of the half-pinion, that is the half of angular displacement of the shaft 30, because movements of both rotors and the shaft for the period FC have a symmetrical character relative to the line 1—1 (FIG. 2*a*) on which both centers of rotation 100 and 110 are located, and 360°/Z is an angular distance between two adjacent teeth of the half-pinion.

Thus, if z=6, $Z_1$ will be 2;

if z=12, $Z_1$ will be 3 and so on.

Alternate start-stop movements of rotors are provided by two similar cylindrical cams 50L and 50R (FIG. 1 ) which are rigidly fixed on the shaft 30 and angularly displaced at 180° relative to each other, shown in FIG. 2*a* and FIG. 2*b*. In this way, the cam 50L works together with the rotor 20L and the cam 50R with the rotor 20R through rolls 29 of the corresponding rotors. Each cam has a hollow 52 whose width H (FIG. 2*a* and FIG. 2*b*) provides a turn of respective rotors 360°/N (FC) and the cylindrical part 53, which provides a stop position of a rotor during the cycle period performed by the other rotor. Thus, considering that any cam and the respective half-pinion provide simultaneously the turn of the rotors to 360°/N, their constructive positions relative to each other on the shaft 30 are predetermined by the common axis 2, as shown in FIG. 2*a* and FIG. 2*b*.

More details about the constructive features mentioned above, of the part of the engine will be given below in the description of engine operation of the engine.

The operation of the engine is based on the principle, which will be better understood by referring to FIG. 2 and FIG. 7. For example, it is shown how the FC is being formed by the rotor 20R, according to the present invention. In FIG. 2*a* and FIG. 2*b* geometrical positions rotor 20L to keep on turning in the same direction. In this stage of the cycle, the forces converting the energy of burning fuel into rotation of the shaft 30 are acting in the following way. Burning gases in the chamber 74 influence both rotors with similar pressure in the opposite directions. The force P of this pressure applied to the diaphragm 24 in the clockwise direction turns the rotor 20R in the position II. The rotor 20R being in connection through teethed gearing with the shaft 30, turns the shaft in the of all parts of engine are shown at the moment when both rotors are going to start their common turn in the clockwise direction. The rotor 20R is ready to begin a full cycle process FC from position I, and the rotor 20L did not finished its own FC yet and is still in the process of turning (pos.II). In this stage of the cycle, as it is shown in FIG. 2*a*, the following events take place:

phase of intake of the air-fuel mixture through port 120 into chamber 70, which is formed between diaphragm 24*a* of the turning rotor 20L and diaphragm 24*m* of the motionless rotor 20R;

compression and following combustion of fuel from the previous cycle takes place in chamber 72, which is formed between the right side of the diaphragm 24*a* (rotor 20L and the left side of the diaphragm 24*k* (rotor 20R). At this point it is necessary to say that the pressure from expanding gases of burning fuel on both rotors through diaphragms 24*a* and 24*e* must be produced either at the moment of the beginning FC performed by subsequent rotor 20R (pos. I), or during the period when both rotors making the common turn to ψ°;

the power stroke takes place in chamber 74, where under pressure of gases rotor 20L takes the position II;

the phase of first exhaust through the port 124 is realized in the chamber 76, which is formed by the diaphragm 24 (rotor 20L) and the diaphragm 24 (rotor 20R);

the cooling air enters through the port 126 into the chamber 78, which is formed by the diaphragm 24*b* (rotor 20L) and the diaphragm 24*n* (rotor 20R) mixing with the remains of products of combustion after the first exhaust;

the final stroke of the mentioned cycle, which is performed by the rotor 20L, produces the second exhaust of mixture mentioned above from the chamber 78 through the port 128 in the chamber 180, formed by diaphragms 24*b* (rotor 20L) and 24*m* (rotor 20R).

As shown in FIG. 2*a*, at this time, the first tooth of the half-pinion 40R enters in contact with the teeth of the gear 28, defining the beginning of rotation of the rotor 20R in the same direction, i.e. the beginning of the rotor 20R and the half-pinion 40L at this time, as shown in FIG. 2*b*, is still in the connection with the gear 28 of the rotor 20L.

In these positions of both rotors, the hollow 52 of the cam 50R enters the zone where the roll 29*m* is located, letting the rotor 20R to turn in the clockwise direction (FIG. 2*a*).

At this time, the roll 29*a* (rotor 20L) is in the zone of the hollow 52 of the cam 50L (FIG. 2*b*) providing an opportunity for the rotor 20L to keep on turning in the same direction. In this stage of the cycle, the forces converting the energy of burning fuel into rotation of the shaft 30 are acting in the following way. Burning gases in chamber 74 influence both rotors with similar pressure in the opposite directions. The force +P of this pressure applied to the diaphragm 24 in the clockwise direction turns the rotor 20R in the position II. The rotor 20R being in connection through teethed gearing with the shaft 30, turns the shaft in the same direction, as shown in FIG. 2*b*. The force −P, which is equal to the force +P, but applied to the right side of the diaphragm 24*k* in the opposite direction hold the rotor 20R in the stop-position I for the part of the period FC of the rotor 20L, because the cylindrical part 53 of the rotating cam 50R, being in contact with the roll 29*n*, prevents the rotor 20R from turning backward. As mentioned above, this moment is the beginning of the process of energy accumulation by the expanding gases in the combustion chamber 72, whose symmetrical pressure on the left side of the diaphragm 24*k* (force +P2) and on the right side of the diaphragm 24*a* (force −P2) balances forces +P and −P in the power chamber 74. Because both rotors will be in connection with the shaft 30 during the period of their common turn to ψ°, the total action of All forces mentioned above the shaft's motion will make $P=P_{1+}P_{2+}(-P_1)+(-P_2)$, regardless of any pressure changes occuring in chambers 72 and 74 during the discussed changes occurring in chambers 72 and 74 during the discussed period. In this case, the further common motion of both rotors will convert the force of inertia into the rotational phase of the shaft 30, providing its smooth connection with the rotor 20R, because at this moment when the first tooth of the half-pinion 40R gets into contact with the tooth of the gear 28 (FIG. 2*a*), the rotor 20R, being in the friction contacts with the turning rotor 20L and through the roll 29*k*, with the rotating shaft 30, starts its own independent motion in the clockwise direction under the pressure from forces of friction mentioned above.

Figure 3B:
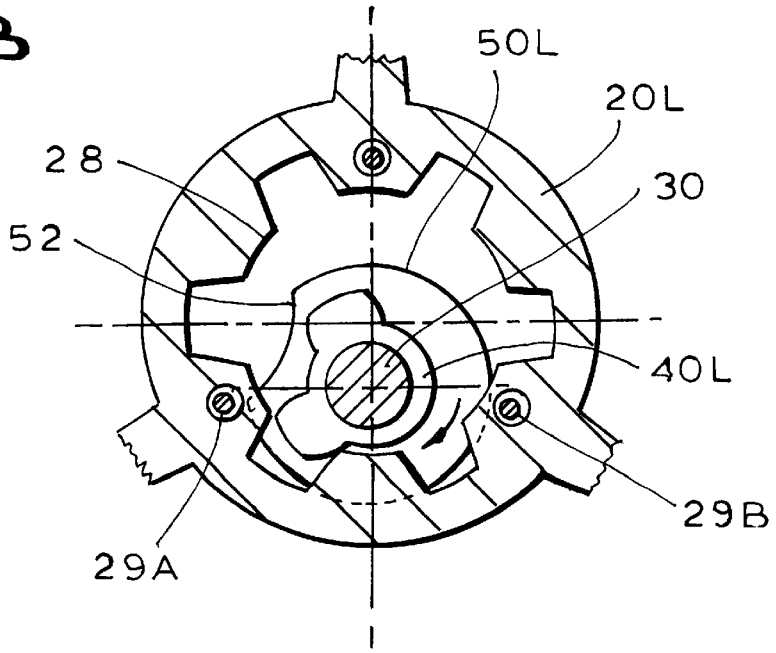
Figure 3A:
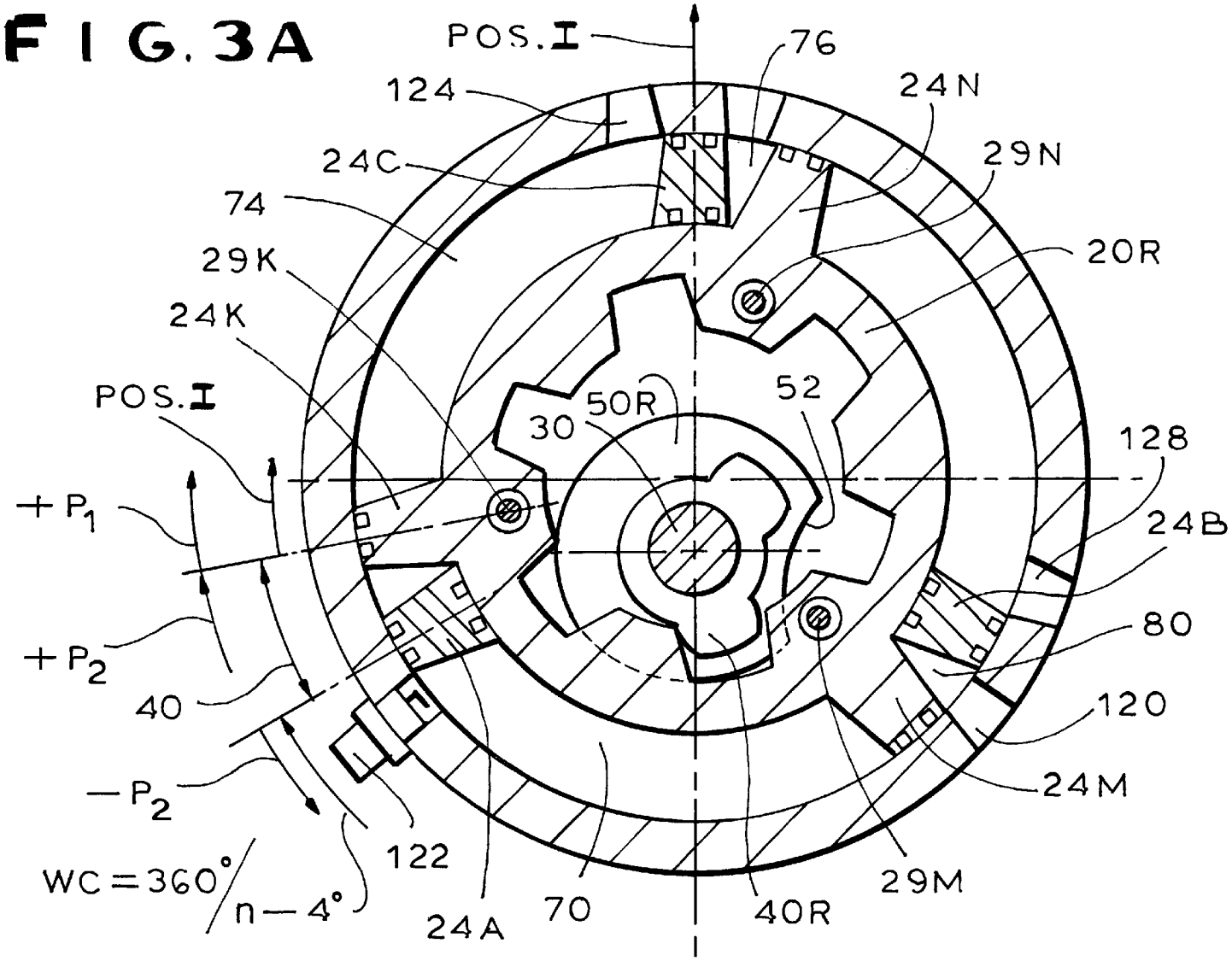

The next stage of the cycle defines the period when preceding cycle (by the rotor 20L) takes place at the same time with the following cycle (by the rotor 20R). This stage of change cycles is characterized by the rotor 20R which turns to ψ°, occupying the position III, which defines the beginning of its transition into the working cycle (WC), and the rotor 20L which occupies the position I, completes its FC. Ending of FC of the rotor 20L coincides with the ending of its WC, as shown in FIG. 3*a*. As can be seen, the displacement of all formed chambers to ψ° stops, as shown in FIG. 3*a*, the fuel access to the chamber 70 from the port 120 provides entrance of the chamber 70 into the zone of operation of the ignition system 122, opens the port 124 for evacuation of burned gases (First exhaust) from the chamber 74, stops air access from the port 126 into the chamber 78, and provides entrance chamber 76 with the remains of products of combustion, into the zone of operation of the port 126.

Simultaneously, the port 128 opens for the second exhaust of the remains of products to combustion from the chamber 78, and the burned gases free chamber 80 enters into the operating zone of the intake port 120. In these positions, the shaft which has a higher angular velocity of rotation than the rotors connected with it, turns during the indicated period by an angle of ψ°. Therefore, when the half-pinion 40R enters into connection with the gear 28 of the rotor 20R as shown in FIG. 3*a*, and the half-pinion 40L disconnects from the gear 28 of the rotor 20L as shown in FIG. 3*b*, then correspondingly, the cam 50R increases the distance between the beginning of its hollow 52 and the roll 29*m*, not preventing the rotor 20R from moving in the same direction (see FIG. 3*a*). In the meantime, the cam 50L engages with the roll 29*a*, and the cylindrical part of the cam 53 engages with the roll 29*b*, limiting the movement of the rotor 20L because of the different trajectories of movement of the rotor and the cam. The cam 50L fixes the rotor 20L in the position I (FIG. 3*b*). In this stage redistribution of forces of pressure of burning gases takes place.

During the time of the common turn of both rotors by an angle ψ, the air-fuel mixture burns completely in the chamber 72 and pressure of expanding gases increases significantly. The forces +P2 and −P2 of this pressure, which act symmetrically on adjacent diaphragms 24*a* and 24*k* considerably exceed the forces acting in the chamber 74, in which pressure abruptly dropped because the exhaust port 124 opens. Thus, the force −P2 neutralizes practically equally force of inertia I of the moving rotor 20L and slows down its movement providing complete and smooth stop in position I, as shown in FIG. 3*b*.

Thus, the consequent WC is performed by the rotor 20R under the influence of pressure +P1 in the chamber 72 and forces of inertia $I_r$ and $I_s$ of the turning rotor 20R and the shaft 30($F=P_{r's}+I+l$) where F is a cumulative force which is applied to the rotor 20R during the period of the forming cycle WC.

In FIG. 4*a* the intermediate position of the rotor 20R is shown when it turns by an angle 60° from the position I (at the moment of performing cycle WC). It can be seen that the turning rotor 20R which changes the volume of chambers between its diaphragms and those of the motionless rotor 20L, forms WC. At this point, the turning rotor 20R continues to be in connection with the shaft 30. The roll 29*m* is in the middle of the hollow 52 of the cam 50R. The rotating cam 50L runs in between rolls 29*a* and 29*b* of the rotor 20L with its cylindrical part 53 fixing the rotor in the position I (see FIG. 4*b*), because the rotor 20L and the cam 50L have different trajectories of movement.

Taking into consideration the short duration of the cycle, the influence of the force of inertia from previous movement of the rotor 20L, which is neutralized by the force −P, as mentioned above, reduces pressure of the roll 29*a* on the cam 50L, and the rolling friction between them reduces power loss.

FIG. 5*a* and 5*b* show the position of rotors at the moment of the next change of cycles, when the rotor 20L already begins its FC. This position of both rotors and the shaft 30 is similar to their positions shown in FIGS. 2*a* and 2*b*, but now the rotor 20R occupies the position II repeating the whole sequence of strokes which is similar to the one described above. From this moment, both rotors make common turn by an angle of 4° as shown in FIGS. 6*a* and 6*b*. Thus, the rotor 20R in the position I completes its FC and stops, and the rotor 20L occupies the position III which defines the beginning of the next WC.

Diagram or FIG. 7 provides clearer and more complete explanation of the character of the described cycle, which depends on the alternate movement of rotors and continuous rotation of the shaft, which in turn operate the start-stop movement of rotors with the use of the toothed gearing mechanism. The curve 1R characterizes the cyclic motion of the rotor R for the period of its turn to 360° (axis Y) and defines the number and periodicity of cycles performed by each diaphragm of the moving rotor, and, corresponding to the periodicity, the angular turns of the engine shaft (axis X)). The angle of the turns depends on the transmission ratio I between the turn of the shaft by an angle of 180° and the turn of the rotor by $^{360°}/N-\psi°$ (in the given model of engine I=180°/120=ctgd.

The curve 1L defines the identical form of the movement of the rotor L (axis Y). Sections of curves 1R and 1L which are arranged at an angle of +° relative to the axis ψ, define the turn of every rotor to 120° and correspondingly the turn of the shaft to an angle of 12°/(FC of the engine). Sections of the curves, which are parallel to the axis X, define the angular turn of the shaft, which forms to "stop" mode of rotors. Thus, the sum of these two periods of rotation of the shaft $[^{360°}/N+(^{360°}/N-2\psi°)]$ I=360° defines the start and stop motion of rotors.

Figure 8:
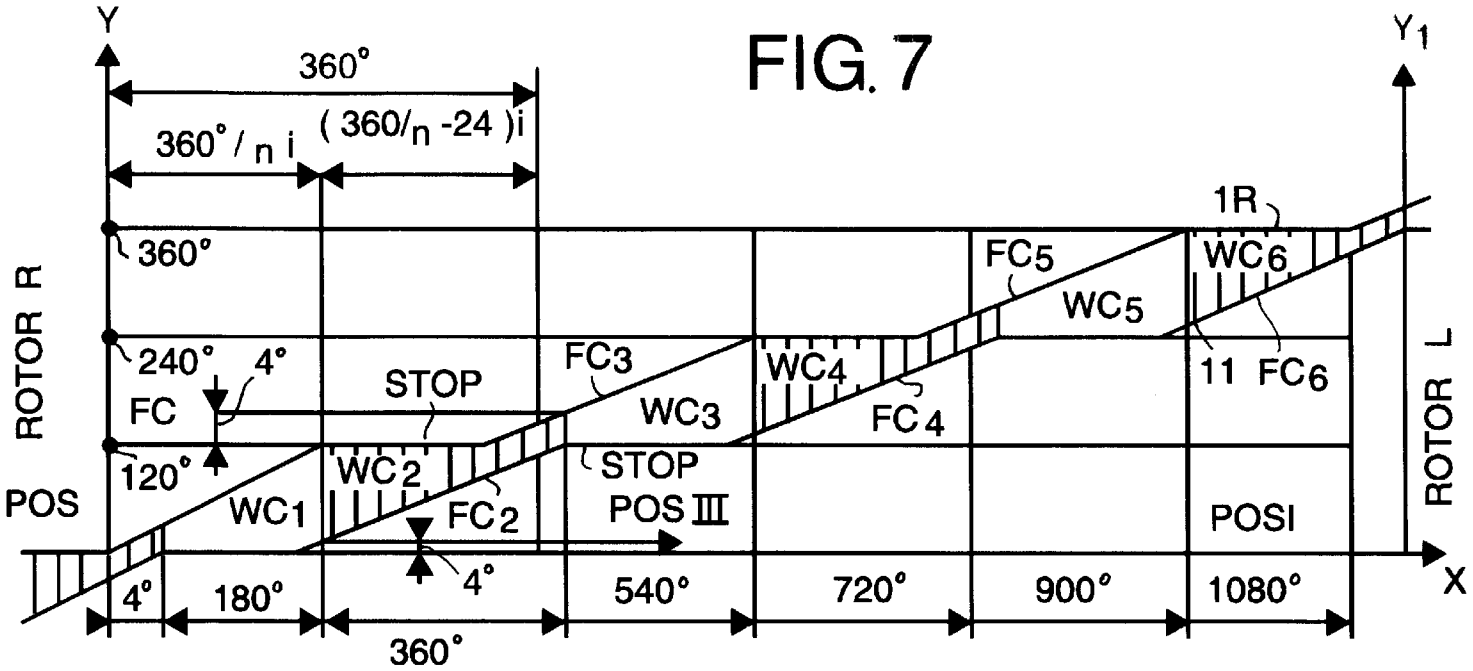

Both curves 1R and 1L produce the cycle which completely corresponds to the scheme of the rotor motion described above. This cycle is characterized by the sequence of changing volumes of chambers between every single side of diaphragm of the turning rotor and the adjacent side of the motionless rotor defining the order and the number of cycles, when each rotor turns to 360°, as shown in the table of FIG. 8.

Taking into consideration that each rotor has three diaphragms, every rotor turning by 360°/N provides simultaneous performance of phase which are shown in the table (FIG. 8), thus forming the complete cycle of the engine in accordance with the present invention. It should be noted that the real cyclic operation of the engine, which is defined as a rule by periods of fuel ignition, is provided by periods of $WC_1$—$WC_2$—$WC_3$—$WC_4$—$WC_5$—$WC_6$ and so on; that is the beginning of WC by each following rotor coincides with the end of WC of every preceding rotor (FIG. 7). And the period of their common turn to ψ is auxiliary for every following rotor, but forming with its WC the complete cycle FC, so as to perform the cycle scheme and therefore to achieve all advantages of the present invention.

Figure 9:
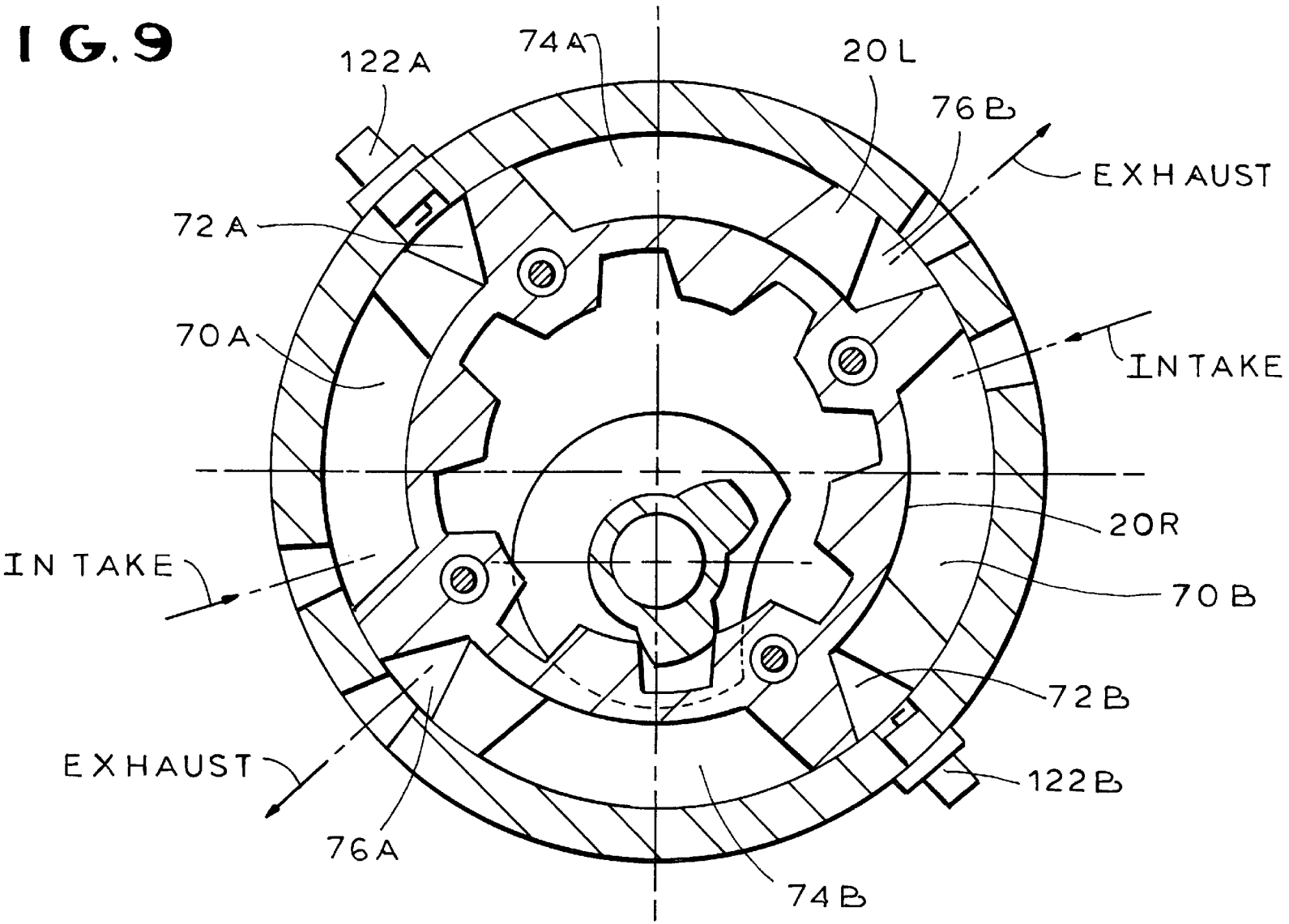
FIG. 9 is a cross-sectional view of portions of the engine taken along line A—A of FIG. 1 as in FIG. 2*a*, but illustrating an example where each rotor has four diaphragms providing the double four strokes-per-cycle engine.

Another version of the rotary engine in accordance with the present invention is shown in FIG. 9. This engine includes two 4-diaphragm rotors. According to the regularity and principles of operation discussed above, these rotors produce the following 8 strokes (double 4 strokes) of the cycle:

intake into chambers 70*a*, 70*b;* compression and subsequent combustion in chambers 72*a*, 72*b;* the power stroke in chambers 74*a*, 74*b* exhaust from chambers 76*a*, 76*b*

The full cycle FC=$^{360°}/N$=90°. The working cycle WC=90°−4°. The transmission ratio I=$^{180°}/90-\psi°$. The number of teeth Z of the gear 28 is chosen from the following sequence: 8, 16, 24, and so on. Thus, the number of teeth of the half-pinion $Z_1$ ..=$^{Z}$/2N+1 (if Z=8=>$Z_1$=2, Z=16=>$Z_1$=3, and so on).

It will be understood that each of the elements described above, or two or more together, may also find a useful application in other types of constructions differing from the types described above.

While the invention has been illustrated and described as embodied in rotary internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

I claim:

1. A rotary engine, comprising a stationary casing having an internal cylindrical surface with an axis; two substantially identical cylindrical rotors rotatable about a common axis coinciding with said axis of said cylindrical surface in a start mode and a stop mode in a same direction so that one rotor starts to move before another rotor finishes its movement to provide a common turn; a power output shaft rotatable mounted in said casing and having an axis of rotation which is parallel to and displaced from said common axis of said rotors, transmission means including two substantially identical half-pinions which are mounted on said shaft and angularly displaced relative to one another by an angle of 180°, and means producing an alternate movement of said rotors in said start and stop modes, said alternate movement producing means including two substantially identical cylindrical cams which are mounted on said shaft and angularly displaced relative to one another at an angle of substantially 180°, each of said rotors having an external cylindrical surface and an N number of diaphragms mounted equidistantly around said external cylindrical surface, each of said rotors having concentrically displaced rolls whose number is equal to the number of said diaphragms, each of said cams having a cavity with a width and a size producing a turn of said rotor by 360°/N, and a cylindrical part with a diameter providing through a contact with said rolls a motionless position of said rotor during a period 360°N−2+° of the movement of said shaft.

2. A rotary engine, comprising a stationary casing having an internal cylindrical surface with an axis; two substantially identical rotors which are supported in said casing rotatably relative to one another about a common axis, each of said rotors having N diaphragms forming chambers there between, an internal gear and a plurality of rolls whose number and angular arrangement around said common axis of each of said rotors equals to a number and arrangement of said diaphragms 360°/N; a power output shaft located inside said rotors and having an axis which extends parallel to and displaced from said common axis of said rotors; a pair of transmission means each provided for a respective one of said rotors, each of said transmission means having a cam and a half-pinion which are mounted on said power output shaft, said cams having each a periphery with a first portion having a cylindrical surface and a second portion having a hollow angularly displaced relative to one another at an angle 180°, each of said cams being arranged on said shaft relative to a corresponding one of said half-pinions of said transmission means so that when said one half-pinion is in toothed engagement with said internal gear of a corresponding one of said rotors, said cam is disconnected from said rolls of said corresponding rotor by said hollow during period of rotation 360°/N, and when said half-pinion is not in the toothed engagement with said internal gear said cylindrical surface of said cam is in contact with two adjacent rolls of said rotor so as to define a stationary position of said rotor during a period 360°/N−2ψ° while the other of said rotors rotates during said period 360°/N, wherein ψ° is a period when both said rotors rotate together, to thereby provide for each revolution of said shaft said period of said rotation and said stationary position for each rotor, said casing having at least one angularly spaced intake port for fuel, and ignition means and an exhaust port all communicating with said chambers, said ignition means being located between said intake port and said exhaust port and an angular distance 360°/N−ψ from said intake port and at an angular distance 360°/N from said exhaust port provide a period of combustion which is equal to a period of a joint rotation of both said rotors.

3. A rotary engine as defined in claim 2, wherein said cams have a common axis of rotation with said output shaft.

4. A rotary engine as defined in claim 2, wherein said cylindrical surface of each of said cams has a radius which is equal to a distance between an axis of rotation of said shaft and a point of contact of said cylindrical surface of said cam with said adjacent rolls, wherein said cam is in contact with said adjacent rolls.

5. A rotary engine as defined in claim 2, wherein said hollow of each of said cams having an angular width equal to a difference between an angle of rotation of said shaft 360°/N×I, wherein I is a ratio of a pitch diameter of said internal gear of each of said rotors to a pitch diameter of a respective one of said half-pinions of said transmission means, and an angle between said points of contact of said cylindrical surface of said cam with said adjacent rolls.

6. A rotary engine as defined in claim 2, wherein said casing further has an intake port for air and an exhaust port for mixture of air with exhaust gas, said port and said ignition means communicating with said chambers, said rotors including six diaphragms provided on said rotors so as to obtain a six-stroke cycle mode.

7. A rotary engine as defined in claim 2, wherein said casing further has an intake port for air and an exhaust port for mixture of air with exhaust gas, said port and said ignition means communicating with said chambers, said rotors including four diaphragms provided on said rotors so as to obtain a four-stroke cycle mode.

* * * * *